United States Patent [19]

Sevastakis

[11] Patent Number: 4,493,361

[45] Date of Patent: Jan. 15, 1985

[54] CONTINUOUS CASTING APPARATUS

[76] Inventor: Gus Sevastakis, 5645 Angola Rd., Toledo, Ohio 43615

[21] Appl. No.: 327,958

[22] Filed: Dec. 7, 1981

[51] Int. Cl.[3] ..... B22D 11/124

[52] U.S. Cl. ..... 164/443; 164/485

[58] Field of Search ..... 164/348, 421, 443, 464, 164/465, 485

[56] References Cited

U.S. PATENT DOCUMENTS 2,613,411 10/1952 Rossi ..... 164/443

3,592,259 7/1971 Adamec ..... 164/443

*Primary Examiner*—Nicholas P. Godici

*Assistant Examiner*—Maureen Weikert

*Attorney, Agent, or Firm*—Barnes, Kisselle, Raisch, Choate, Whittemore & Hulbert

[57] ABSTRACT

A continuous casting apparatus wherein molten metal flows through a die progressively and is solidified in the die and withdrawn from the die including a die and cooling assembly comprising a tubular die having an external tapered surface which is uniformly tapered radially inwardly in the direction of movement of metal to the die, a cooling sleeve having an internal surface complementary to the external surface on the die and in substantial intimate surface contact with the external surface of the die and an annular cooling shell surrounding the cooling sleeve and having portions thereof spaced from the sleeve to define a cooling chamber. The die and cooling assembly includes at least one inlet to the chamber and at least one outlet from the chamber, the inlet and the outlet being spaced axially with the outlet being nearest the inlet end of the die into which the molten metal flows. The cooling sleeve has a plurality of circumferentially spaced integral ribs extending radially outwardly therefrom into close proximity to the inner surface of said cooling shell such the coolant flows in a thin layer along the inner surface of the cooling shell along the outer surface of the cooling sleeve. The cooling sleeve has a plurality of axially extending circumferentially spaced axial openings positioned intermediate the inner and outer surfaces thereof and a first and second set of radial passages extends from the cooling chamber to the axial openings.

15 Claims, 8 Drawing Figures

57
56
45
43
40
42
47
51
48
52

54
55
53
40
55a
45
57
50
51
46
47
48
41
42
43
49a
49a
49
56
44
55a
52

CONTINUOUS CASTING APPARATUS

This invention relates to continuous casting.

BACKGROUND AND SUMMARY OF THE INVENTION

In continuous casting of metals such as brass and the like, it is common to permit molten metal to flow from a crucible through a die which is surrounded by a cooling apparatus so that the molten metal progressively solidifies and is withdrawn by suitable apparatus. A major consideration in the efficiency of such a device is the ability to remove heat from the die.

In my U.S. Pat. No. 4,151,765, an efficient apparatus for cooling the die is shown which utilizes a cooling sleeve having intimate contact with the exterior surface of the die, which cooling sleeve is externally cooled by flowing coolant about the periphery thereof. Inasmuch as the coolant that first contacts the cooling sleeve is cold and progressively increases in temperature, there is a tendency for the cooling sleeve to be cooled unevenly and expand out of intimate contact with the die.

Among the objects of the present invention are to provide an improved die and cooling assembly which will efficiently cool and thereby increase the efficiency of the continuous casting apparatus and the quality of the products.

In my copending application Ser. No. 258,590, filed Apr. 29, 1981, abandoned, the die and cooling assembly comprises a tubular die having an external tapered surface which is uniformly tapered radially inwardly in the direction of movement to the die, a cooling sleeve having an internal surface complementary to the external surface of the die and in substantial intimate contact with the external surface of the die, an annular cooling jacket wall surrounding the cooling sleeve and having portions thereof spaced from the sleeve to define a cooling chamber, at least one coolant inlet to said chamber and at least one coolant outlet from said chamber. The inlet and outlet are spaced axially with the outlet being nearest the upper end of the die where the molten metal enters the die and the inlet being nearest the lower end of the die where the solidified metal leaves the die. The cooling sleeve preferably has a plurality of circumferentially spaced integral ribs extending radially outwardly therefrom into close proximity to the inner surface of the cooling jacket such that coolant flows in a thin layer along the inner surface of the cooling jacket and in a plurality of axial paths along the surfaces of the ribs. The ribs are of progressively increasing height circumferentially about the cooling sleeve from the area of the coolant inlet to the area of the coolant outlet.

In certain situations, to increase production to a maximum uniformly greater heat transfer is required. For example, wherein the cross section of the continuous part being made is non-uniform, the die has a varying thickness so that problems arise not only during the casting operation but in the resultant product causing weakness in the final structure, separation of the components of the alloy, non-uniform molecular structure and fractures on the cast products.

Accordingly, the objects of the invention are to provide an improved die and cooling assembly which will efficiently cool the die in situations wherein unusual and excessive heat is present and where the circumferential portions of the die may vary in temperature.

In accordance with the invention the cooling sleeve has a plurality of axially extending circumferentially spaced openings positioned intermediate the inner and outer surfaces thereof and a first set of radial passages extends from the lower end of the cooling chamber to the axial openings and a second set of radial passages extends from the upper end of the axial passages to the chamber and, in turn, said outlet.

DESCRIPTION

Figure 1:
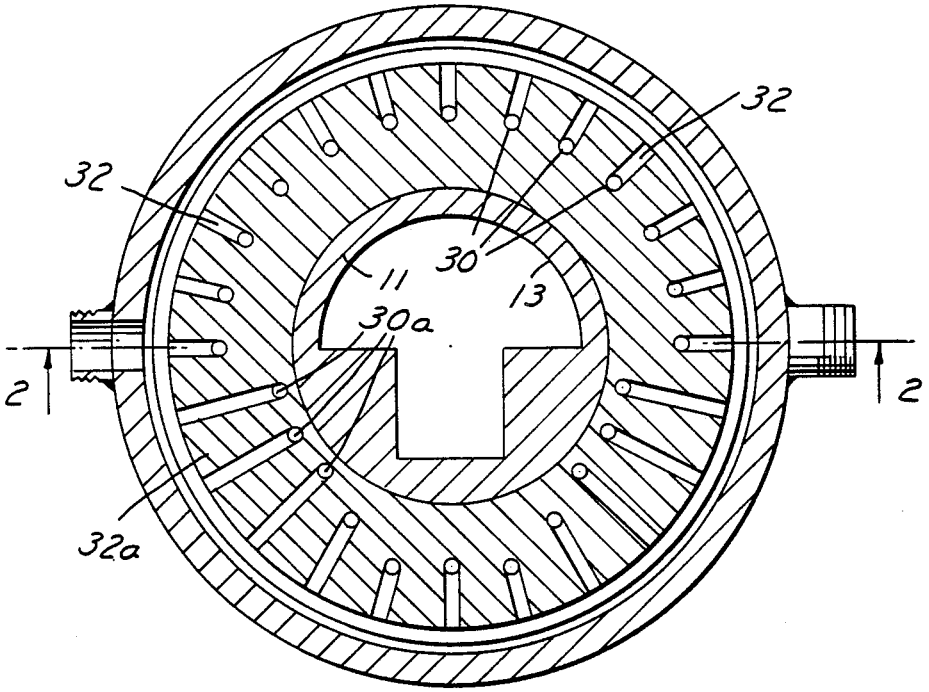
FIG. 1 is a part sectional plan view of a die and cooling assembly embodying the invention taken along the line 1—1 in FIG. 2.
Figure 2:
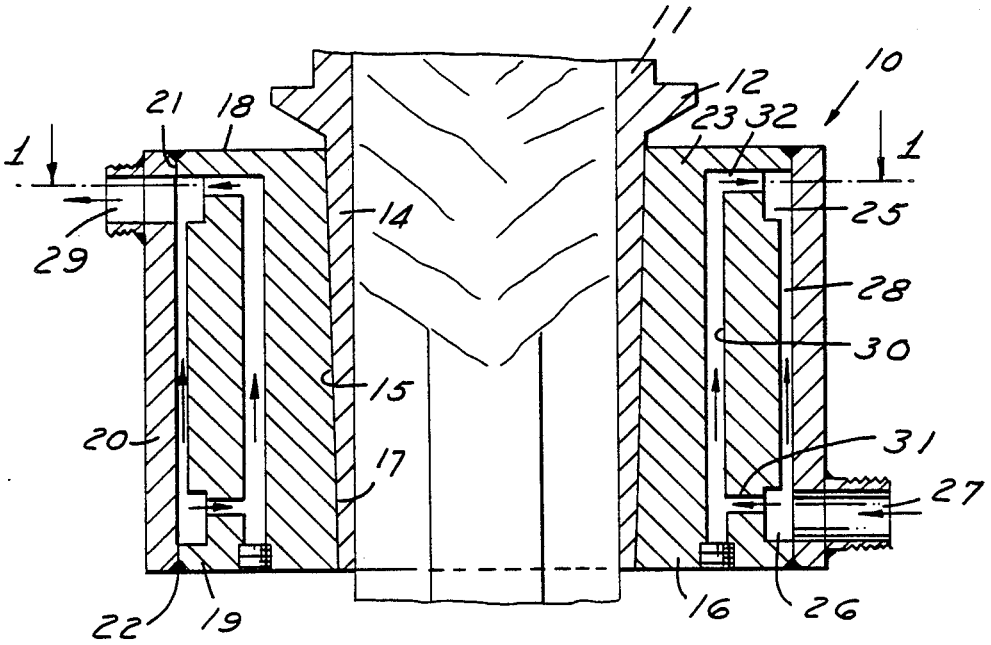
FIG. 2 is a fragmentary sectional view taken along the line 2—2 in FIG. 1.

Referring to FIGS. 1 and 2, the invention relates to a continuous casting apparatus which conventionally includes a crucible that contains molten metal and is kept heated in a furnace which is fired by burners not shown. The molten metal flows through the upper end of a die and cooling assembly 10. More specifically the molten metal flows through the upper end of a tubular die 11 and as it moves through the die progressively solidifies and is withdrawn by intermittently driven withdrawal apparatus such as pinch rolls, not shown. A mandrel may be provided in the event that tubular forms are being made.

The die 11 is made of graphite and includes an intermediate flange 12 for providing a seal with the lower end of the crucible.

The internal surface 13 of the die 11 is shown as generally T-shaped for forming T-shaped products and the lower portion 14 of the die has an outer tapered surface 15 that tapers radially inwardly in the direction of movement of the metal.

The cooling subassembly 23 of the die and cooling assembly 10 includes a cooling sleeve 16 that has an internal tapered surface 17 complementary to the die surface 15 so that there is substantial intimate surface-to-surface contact between the tapered surfaces 15, 17 of the die 11 and the cooling sleeve 16.

The cooling sleeve 16 includes integral upper and lower flanges 18, 19 that extend radially outwardly and are engaged by a cooling shell 20 which is welded as at 21, 22 to the outer surfaces of the flanges 18, 19. Cooling sleeve 16 is formed with annular grooves 25, 26 that define annular plenums in association with cooling sleeve 20.

The cooling subassembly 23 is further formed with an inlet 27 that have its axis along a radial plane through the axis of the die 11 so that coolant such as water entering through the inlet is caused to flow in opposite directions through the chamber 28 between the cooling sleeve 16 and cooling shell 20. The subassembly 23 further includes an outlet 29 at the upper end which extends along a radius.

As previously indicated, the die 11 is preferably made of graphite, the cooling sleeve 16 is preferably made of high conductivity deoxidized copper, which is well known to have high thermal conductivity, and the cooling shell 20 is preferably made of steel.

In accordance with the invention, the cooling sleeve 16 is also formed with a plurality of circumferentially spaced axial openings or passages 30, radial passages 31 at the lower end extending from the outer surface to the passages 30 and radial passages 32 at the upper end extending from the axial passages to the outer surface.

By this arrangement, a secondary flow of coolant is provided axially between the inner and outer surfaces of the cooling sleeve 16. When the product being produced is non-uniform so that the die 11 has a varying thickness, the axial passages 30 are preferably positioned radially nearer the thicker portions of die 11. Thus as shown in FIG. 1, axial passages 30*a* are positioned radially closer to the inner surface of the cooling sleeve which is adjacent the thicker portion of die 11. The radial passages 31, 32 to these axial passages 30*a* are accordingly longer.

Figure 3:
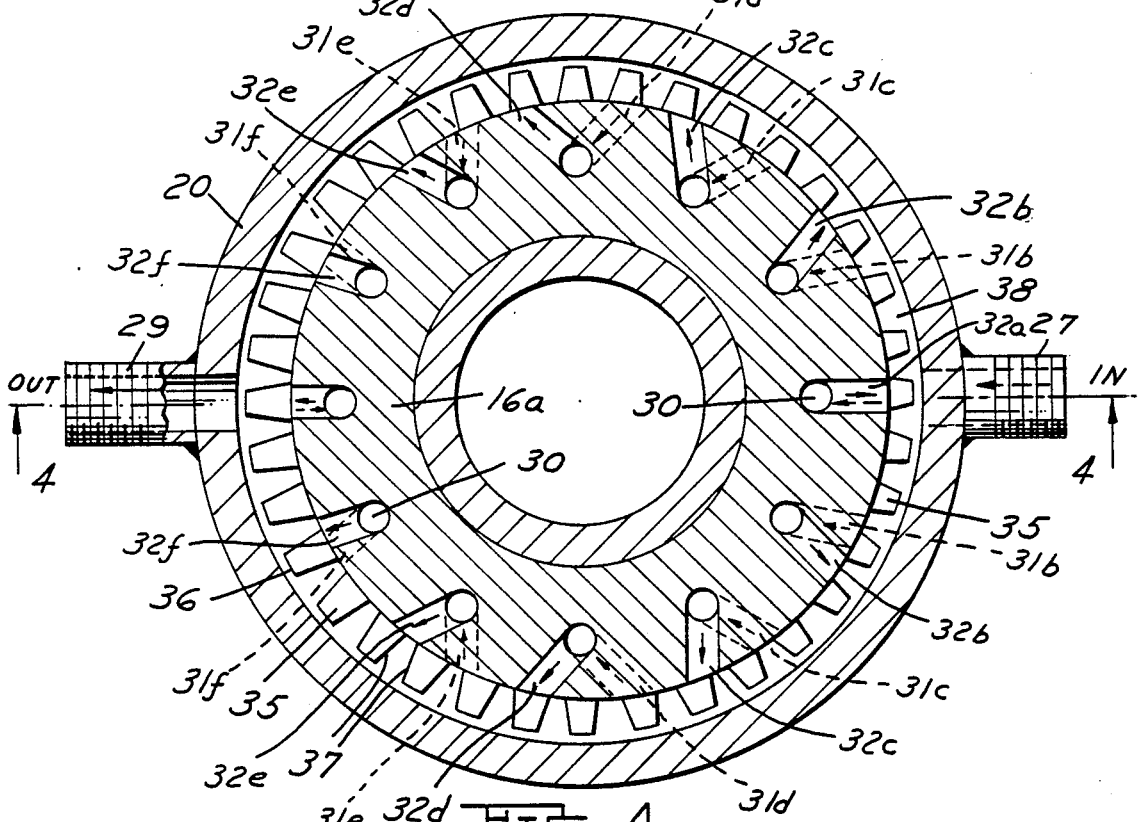
FIG. 3 is a part sectional plan view of a modified form of die and cooling assembly.
Figure 4:
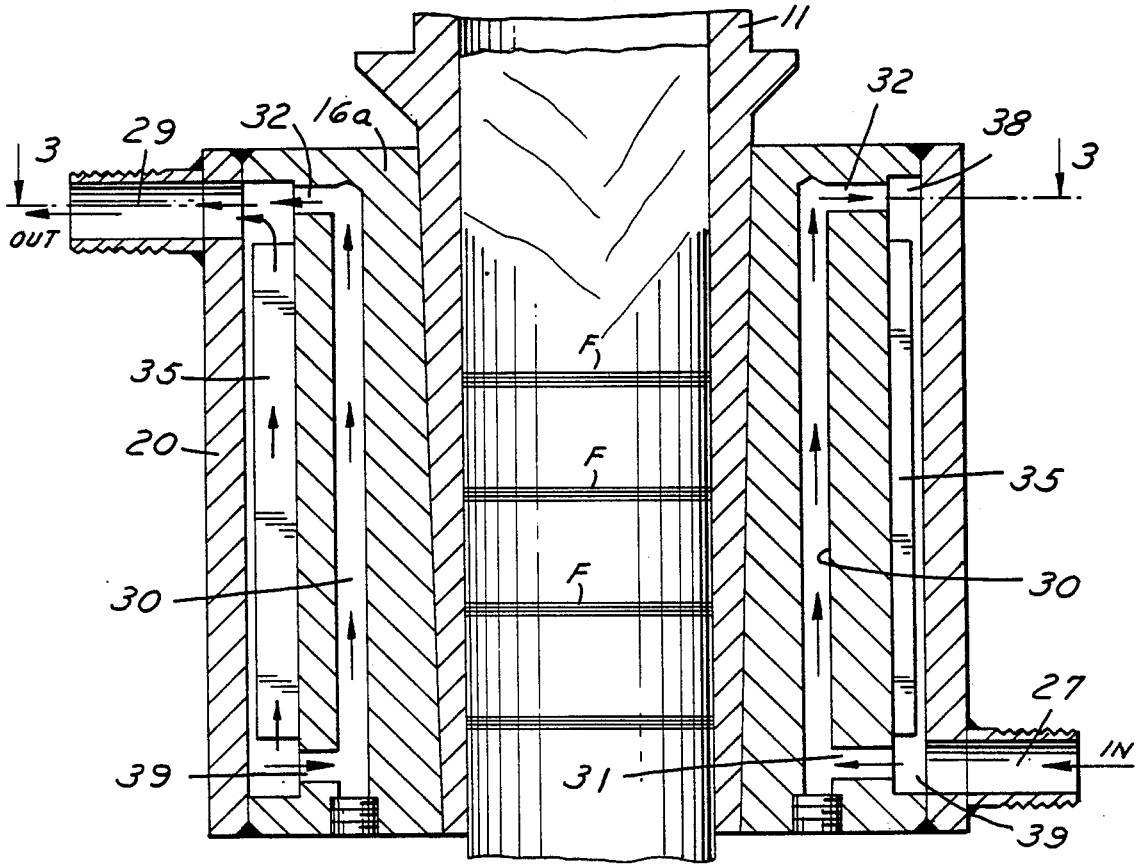
FIG. 4 is a fragmentary sectional view taken along the line 4—4 in FIG. 3.

In the form of the invention shown in FIGS. 3 and 4, the die and cooling assembly is similar to that shown in FIGS. 1 and 2, and corresponding reference numerals are used for clarity. The outer surface of the cooling sleeve 16*a* is cylindrical and is formed with a plurality of axially extending grooves defining a plurality of circumferentially spaced ribs 35 extending radially outwardly into close proximity but in spaced relationship to the inner cylindrical surface of the cooling shell 20. Each rib includes a flat end 36 and tapered side surfaces 37.

The ribs extend along the cylindrical outer surface of the sleeve but are spaced from the flanges 18, 19 to define plenum chambers 38, 39.

The ribs 35 are of progressively increasing height circumferentially about the cooling sleeve 16*a* from the area of the coolant inlet to the area of the coolant outlet. In other words, the grooves that define the ribs increase in depth progressively circumferentially about the sleeve 16*a* from the area of the coolant inlet to the area of the coolant outlet. Since the tips of the ribs 35 lie on a cylindrical surface, the radial cross sectional thickness of the sleeve to the base of each rib is greater and progressively decreases circumferentially from the area of the coolant inlet to the area of the coolant outlet. As a result, as the coolant increases in temperature in moving over the cooling sleeve, a progressively greater cooling area is presented and the interchange of heat is made more uniform so that a substantially equal amount of BTU's is extracted circumferentially from the cast products at given points across the freezing zones F of the products being formed.

The details of construction of ribs 35 are more fully disclosed in the aforementioned U.S. application which is incorporated herein by reference.

In order to minimize turbulence in the coolant and provide smooth flow of the coolant, some of the radial passages 31, 32 have their axes extending at an angle to radial planes more specifically, the radial passages 31*b, c, d, e, f* extend at an angle toward the inlet 27, the passage angle increasing progressively for about 90° to a maximum at 31*d* and thereafter decreasing toward the outlet. Similarly outlet passages 32*b, c, d, e, f* form an angle to radial planes toward the outlet 29, the angles again increasing progressively for about 90° to a maximum at passage 31*d* and thereafter decreasing toward the outlet 29.

Figure 5:
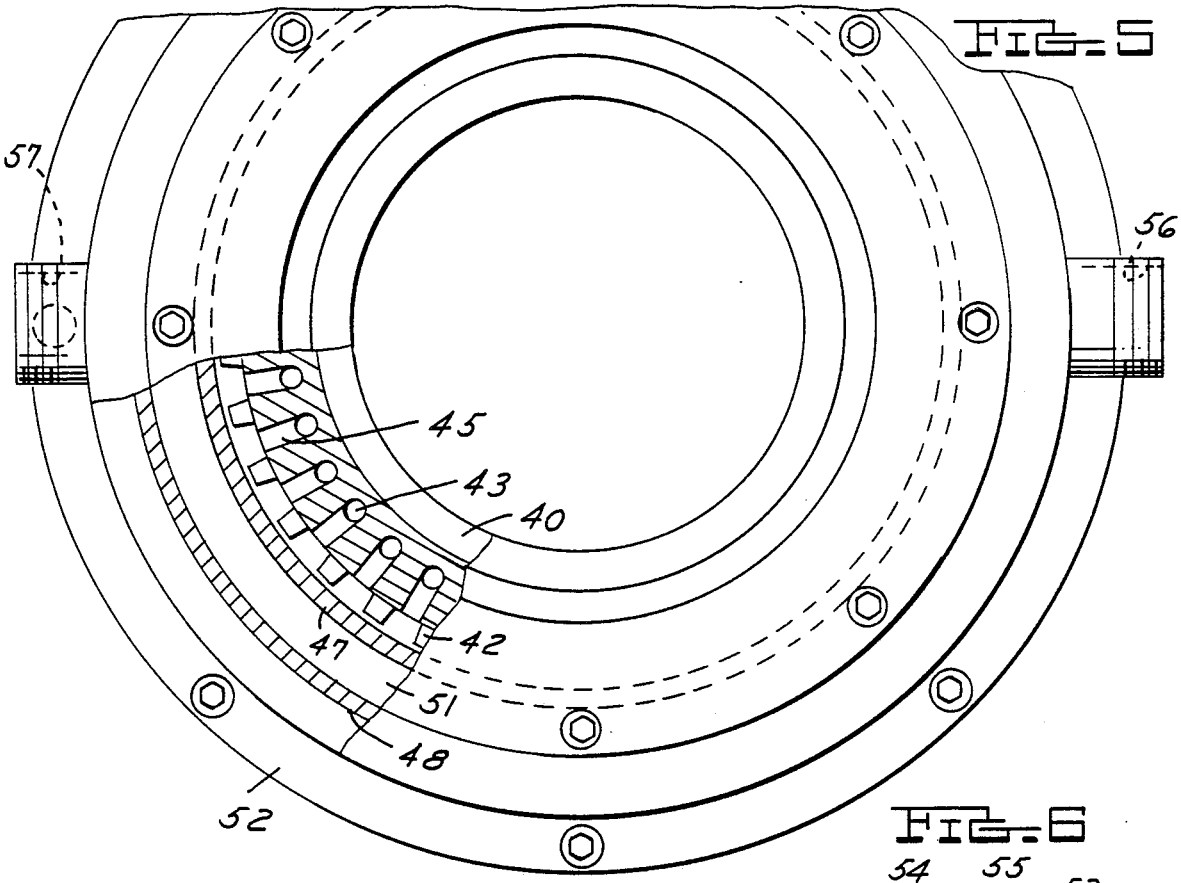
FIG. 5 is a part sectional fragmentary plan view of another modified form of die and cooling assembly.
Figure 6:
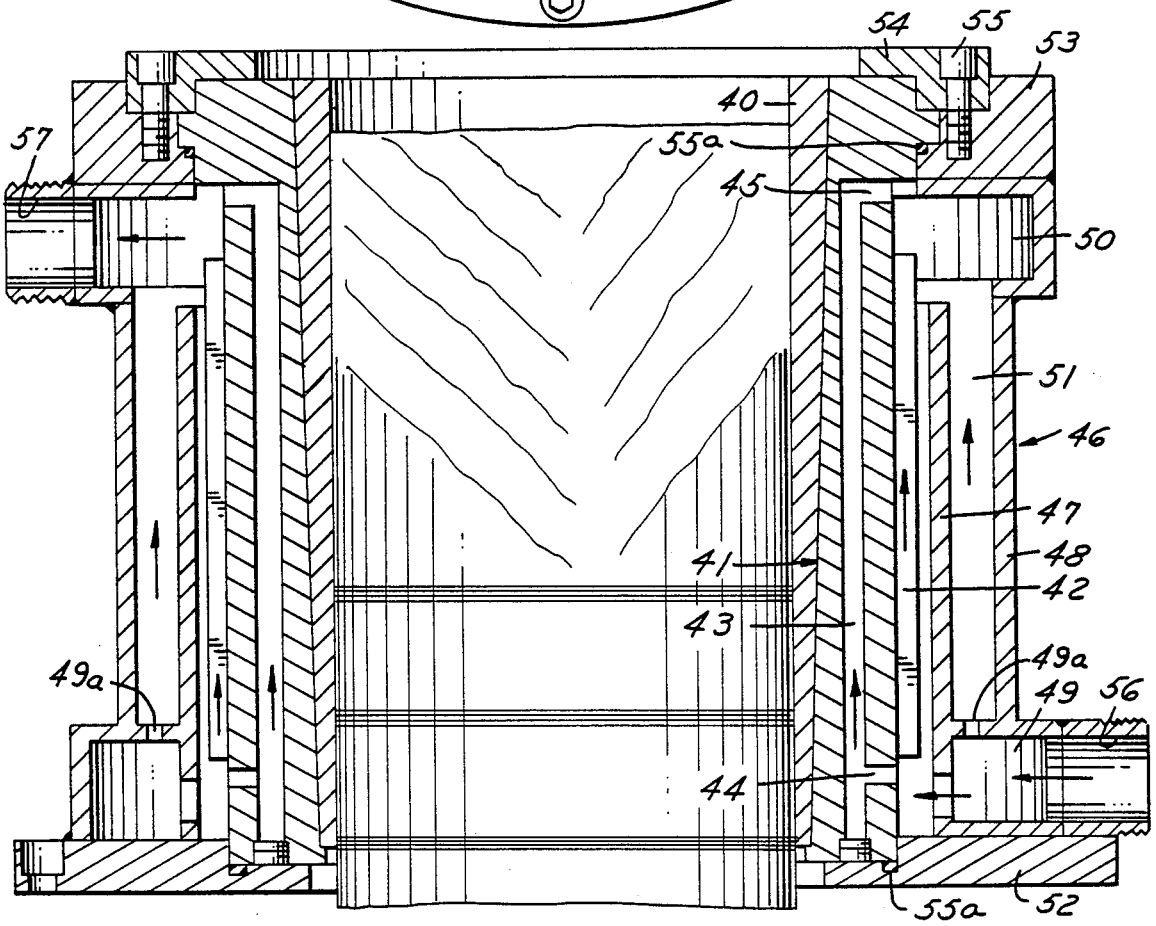
FIG. 6 is a fragmentary sectional view taken along the line 6—6 in FIG. 5.

In the form of the invention shown in FIGS. 5 and 6, the die and cooling assembly is similar to that shown in FIGS. 3 and 4 except that the cooling shell is modified to define a third path or passage for flow of coolant.

More specifically, the die and cooling assembly comprises a die 40, which is of the type into which molten metal is poured rather than being received directly from a crucible, a cooling sleeve 41 having ribs 42 on the outer surface thereof and axial passages 43 intermediate the outer and inner surfaces thereof with radial passages 44, 45 to the periphery. The cooling shell 46 includes spaced walls 47, 48 and communicating plenum chambers 49, 50 at the lower and upper ends thereof defining a third annular path 51 for flow of the coolant from the lower plenum 49 through the openings 49*a* to the upper plenum 50. The area of openings 49*a* is a fraction of the area of inlet 56, preferably approximately 1/10 of the area at the inlet 56. The cooling shell 46 further includes a lower flange 52 that abuts the bottom of the cooling sleeve 41 and an upper flange 53 which is connected to the upper end of the cooling sleeve 41 by a ring 54 and a plurality of bolts 55 extending through the ring into the upper flange. Rubber sealing rings 55*a* are provided for sealing at junctures of flanges 52, 53 and the sleeve 41.

In this form of the invention, coolant thus flows through the inlet 56 to each of three flow paths, one through the axial passages 43, a second along the ribs 42 between the outer surface of the cooling sleeve 41 and the inner surface of the intermediate wall 47 of the cooling shell 48 and a third between the outer surface of intermediate wall 47 and inner surface of the outer wall 48 of the shell 46 to the upper plenum 50 and then in turn to the outlet 57.

Figure 7:
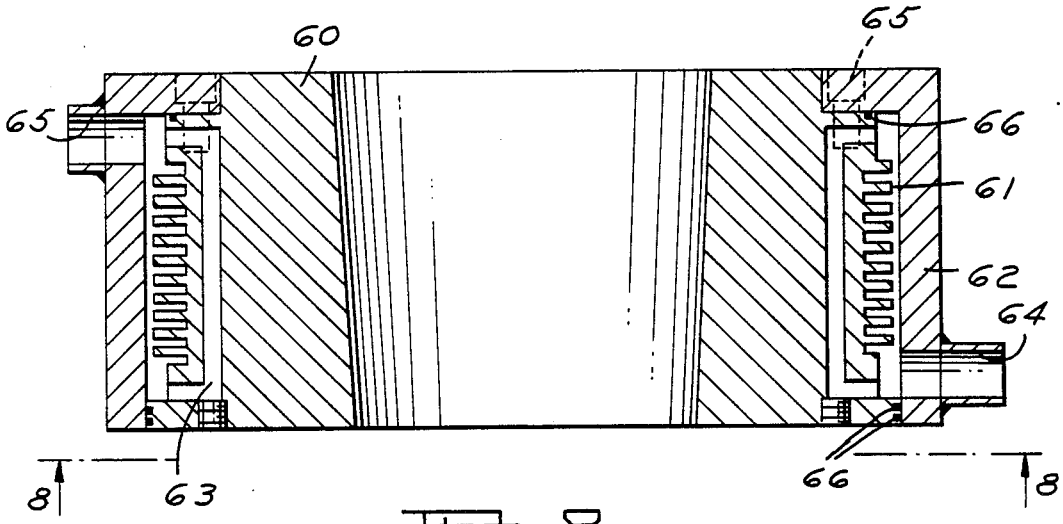
FIG. 7 is a vertical sectional view of another modified form of die and cooling assembly.
Figure 8:
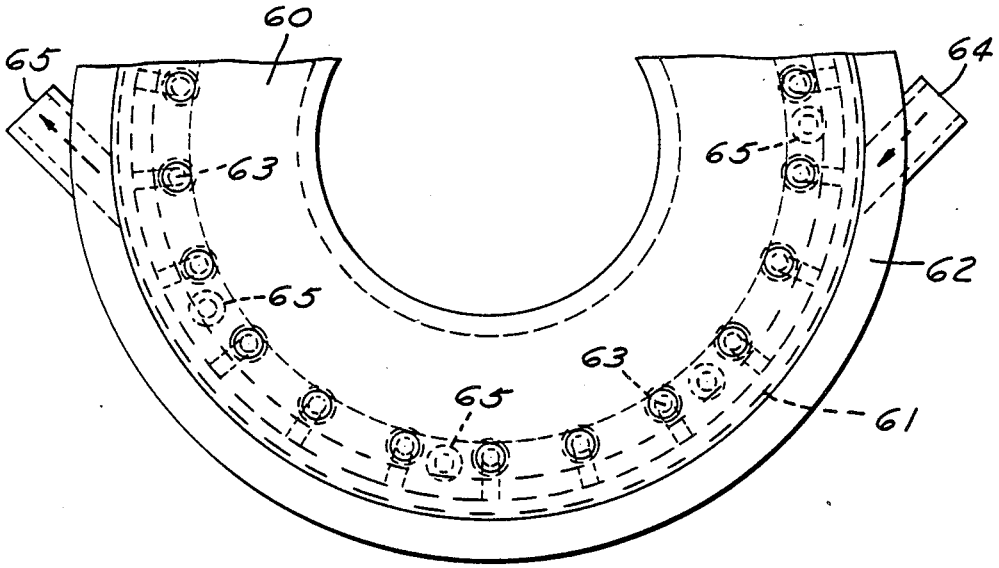
FIG. 8 is a fragmentary bottom plan view taken along the line 8—8 in FIG. 7.

In the form of the invention shown in FIGS. 7 and 8, the cooling assembly includes a cooling sleeve 60 having radially extending axially spaced ribs 61 spaced axially between the outer surface of the cooling sleeve 60 and the inner surface of the cooling shell 62 as well as the axial passages 63 as in the prior forms of the invention. In this fashion, coolant flows from tangential inlet 64 in two paths to the tangential outlet 65, one through axial passages 63 and the other between the outer surface of sleeve 61 and the inner surface of sleeve 62.

Bolts 65 and seals 66 are provided for the cooling assembly.

It can thus be seen that in each form of the invention, the cooling sleeve is provided with a plurality of axially extending circumferentially spaced passages, the lower ends of which communicate with the inlet through radial passages and the upper ends of which communicate with the outlet through radial passages. In this fashion, an additional path for cooling fluid is provided through the radial passages, axial passages and radial passages from the inlet to the outlet. Such a construction not only provides for additional flow of coolant so that there is additional heat transfer, but also permits the axial passages adjacent the thicker portions of die to be positioned in closer proximity than the remaining passages, as shown in FIGS. 1 and 2.

It can thus be seen there has been provided a die and cooling assembly which permits more careful control of the cooling of the die and can be adapted to dies of non-uniform cross sectional configuration.

I claim:

1. In a continuous casting apparatus wherein molten metal flows through a die progressively and is solidified in the die and withdrawn from the die, a die and cooling assembly comprising:

a tubular graphite die having an axial opening with an upper inlet end into which the molten metal is introduced and a lower outlet end, said tubular die having an external tapered surface which is uniformly tapered radially inwardly in the direction of movement of metal to the die, a tubular cooling sleeve having an external surface and an internal surface, said internal surface being tapered and complementary to the external tapered surface of the die and in substantial intimate surface contact with the external tapered surface of said die, an annular cooling shell surrounding said cooling sleeve and having an inner surface and an outer surface thereof spaced from said sleeve, said cooling sleeve being formed with upper and lower flanges engaging the inner surface of said shell to define a circumferentially extending cooling chamber having an upper end and a lower end, said cooling sleeve being formed with an annular groove on the outer surface thereof at the upper and lower ends thereof, respectively, defining an upper annular plenum and lower annular plenum communicating with the upper end and the lower end of said chamber, at least one inlet to said lower plenum, at least one outlet from said upper plenum, said inlet and said outlet being spaced axially with the outlet being nearest the inlet end of the die into which the molten metal flows, said cooling sleeve having a plurality of axially extending circumferentially spaced passages positioned intermediate the inner and outer surfaces thereof and having upper and lower ends and a first set of radial passages extending from the lower plenum to the lower ends of the axial passages, and a second set of radial passages extending from the upper ends of said axial passages to upper plenum and, in turn, said outlet, a radial passage of said second set being provided for the upper end of each axial passage and a radial passage of said first set being provided for the lower end of each of said axial passage.

2. The die and cooling assembly set forth in claim 1 wherein said cooling sleeve has a plurality of circumferentially spaced integral ribs extending radially outwardly from the outer surface thereof and having outer ends in close proximity to the inner surface of said cooling shell such that coolant flows in a thin layer along the inner surface of the cooling shell and in a plurality of paths along the surfaces of said ribs.

3. The die and cooling assembly set forth in claim 2 wherein said ribs extend axially.

4. The die and cooling assembly set forth in claim 3 wherein the internal surface of said cooling shell is cylindrical and the outer ends of said ribs define a cylindrical surface spaced from but in close proximity to the inner surface of said cooling shell.

5. The die and cooling assembly set forth in claim 3 wherein said ribs extend radially and are spaced axially.

6. The die and cooling assembly set forth in claim 1 wherein axial opening in said die has an internal unsymmetrical configuration such that the die has varying thicknesses radially, said axial passages in said sleeve being in closer proximity to said die in the areas where said die has a greater thickness.

7. The die and cooling assembly set forth in claim 1 wherein said annular cooling shell comprises spaced inner and outer walls, said inner wall defining said first chamber in cooperation with said shell, said inner and outer walls defining a second chamber, said inlet communicating with said second chamber and openings providing communication such that cooling fluid flows through said inlet and axially through said axial passages in said cooling sleeve, through said first chamber along said inner surface of said cooling shell, and through said second chamber to said outlet.

8. The die and cooling assembly set forth in claim 7 wherein said annular cooling shell is made as a unitary member and includes said inlet and said outlet such that the shell is assembled to the sleeve after being fabricated.

9. The die and cooling assembly set forth in claim 1 wherein said radial passage of said first set which is adjacent said inlet lying in a radial plane and the remaining radial passages of the first set having their axes lying in planes forming an acute angle to radial planes that increase progressively circumferentially in each circumferential direction from the inlet to a maximum for about 90° and thereafter their axes form progressively decreasing angles circumferentially in each circumferential direction from said inlet to the passage diametrically opposite said inlet, said radial passage of said second set which is adjacent said outlet lying in a radial plane and the remaining radial passages of said second set having their axes lying in planes which form progressively increasing angles with a radial plane for about 90° in each circumferential direction from the outlet and thereafter form progressively decreasing angles with a radial plane in each circumferential direction from said outlet to the passage diametrically opposite said outlet.

10. In a continuous casting apparatus wherein molten metal flows through a die progressively and is solidified in the die and withdrawn from the die, a die and cooling assembly comprising:

a tubular graphite die having an upper inlet end into which the molten metal is introduced and a lower outlet end, said tubular die having an external tapered surface which is uniformly tapered radially inwardly in the direction of movement of metal to the die, a tubular cooling sleeve having an external surface and an internal surface, said internal surface being tapered and complementary to the external tapered surface of the die and in substantial intimate surface contact with the external tapered surface of said die, an annular cooling shell surrounding said cooling sleeve and having an outer surface and an inner surface thereof spaced from said sleeve, said cooling sleeve being formed with upper and lower flanges engaging the inner surface of said shell to define a circumferentially extending cooling chamber having an upper end and a lower end, said cooling sleeve being formed with an annular groove on the outer surface thereof at the upper and lower ends thereof, respectively, defining an upper annular plenum and lower annular plenum communicating with the upper end and the lower end of said chamber, at least one inlet to said lower plenum, at least one outlet from said upper plenum, said inlet and said outlet being spaced axially with the outlet being nearest the inlet end of the die into which the molten metal flows, said cooling sleeve having a plurality of circumferentially spaced axially extending integral ribs extending radially outwardly from the outer surface thereof and having outer ends in close proximity to the inner surface of said cooling shell such that coolant flows in a thin layer along the inner surface of the cooling shell and in a plurality of axial paths along the surfaces of said ribs, said cooling sleeve having a plurality of axially extending circumferentially spaced passages positioned intermediate the inner and outer surfaces thereof and having upper and lower ends and a first set of radial passages extending from the lower plenum to the lower end of the axial passages and a second set of radial passages extending from the upper ends of said axial passages to said upper plenum and, in turn, said outlet, a radial passage of said second set being provided from the upper end of each axial passage and a radial passage of said first set being provided for the lower end of each said axial passage, said radial passage of said first set which is adjacent said inlet lying in a radial plane and the remaining radial passages of the first set having their axes lying in planes forming an acute angle to radial planes that increase progressively circumferentially in each circumferential direction from the inlet to a maximum for about 90° and thereafter their axes form progressively decreasing angles circumferentially in each circumferential direction from said inlet to the passage diametrically opposite said inlet, said radial passage of said second set which is adjacent said outlet lying in a radial plane and the remaining radial passages of said second set having their axes lying in planes which form progressively increasing angles with a radial plane for about 90° in each circumferential direction from the outlet and thereafter form progressively decreasing angles with a radial plane in each circumferential direction from said outlet to the passage diametrically opposite said outlet.

11. In a continuous casting apparatus wherein molten metal flows through a die progressively and is solidified in the die and withdrawn from the die, a cooling assembly comprising:

a tubular cooling sleeve having an external surface and an internal surface, said internal surface being tapered and adapted to be complementary to an external tapered surface of the die and in substantial intimate surface contact with the external tapered surface of the die, an annular cooling shell surrounding said cooling sleeve and having an outer surface and an inner surface thereof spaced from said sleeve, said cooling sleeve being formed with upper and lower flanges engaging the inner surface of said shell to define a circumferentially extending cooling chamber having an upper end, said cooling sleeve being formed with an annular groove on the outer surface thereof at the upper and lower ends thereof, respectively, defining an upper annular plenum and lower annular plenum communicating with the upper end and the lower ends of said chamber, at least one inlet to said lower plenum, at least one outlet from said upper plenum, said inlet and said outlet being spaced axially with the outlet being nearest the inlet end of the die into which the molten metal flows, said cooling sleeve having a plurality of axially extending circumferentially spaced passages positioned intermediate the inner and outer surfaces thereof and having upper and lower ends and a first set of radial passages extending from the lower plenum to the lower ends of the axial passages and a second set of radial passages extending from the upper end of said axial passages to said upper plenum and, in turn, said outlet, a radial passage of said second set being provided for the upper end of each axial passage and a radial passage of said first set being provided for the lower end of each said axial passage.

12. The cooling assembly set forth in claim 11 wherein said cooling sleeve has a plurality of circumferentially spaced integral ribs extending radially outwardly therefrom and having outer ends in close proximity to the inner surface of said cooling shell such that coolant flows in a thin layer along the inner surface of the cooling shell and in a plurality of paths along the surface of said ribs.

13. The cooling assembly set forth in claim 12 wherein said ribs extend axially.

14. The cooling assembly set forth in claim 13 wherein the inner surface of said cooling shell is cylindrical and the outer ends of said ribs define a cylindrical surface spaced from but in close proximity to the inner surface of said shell.

15. The cooling assembly set forth in claim 11 wherein said axial passages in said sleeve are in closer proximity to the inner surface of said cooling sleeve in some areas than in other areas.

* * * * *